United States Patent [19]

Sofianek et al.

[11] 3,969,598

[45] July 13, 1976

[54] VACUUM-TYPE CIRCUIT INTERRUPTER WITH A PLURALITY OF SETS OF CONTACTS IN PARALLEL

[75] Inventors: Joseph C. Sofianek, Broomall; Donald R. Kurtz, West Chester, both of Pa.

[73] Assignee: General Electric Company, Philadelphia, Pa.

[22] Filed: Feb. 3, 1975

[21] Appl. No.: 546,475

[52] U.S. Cl. ..... 200/144 B
[51] Int. Cl.[2] ..... H01H 33/66
[58] Field of Search ..... 200/144 B; 313/217, 313/233

[56] References Cited

UNITED STATES PATENTS

| | | | |
|---|---|---|---|
| 2,897,322 | 7/1959 | Reece | 200/144 B |
| 2,972,005 | 2/1961 | Brealey et al. | 174/99 |
| 3,210,505 | 10/1965 | Porter | 200/144 B |
| 3,321,598 | 5/1967 | Streater | 200/144 B |
| 3,471,734 | 10/1969 | Rich | 313/217 |
| 3,509,404 | 4/1970 | Rich | 200/144 B |
| 3,670,123 | 6/1972 | Luehring | 200/144 B |
| 3,679,474 | 7/1972 | Rich | 200/144 B X |
| 3,769,538 | 10/1973 | Harris | 313/233 |
| 3,786,214 | 1/1974 | Sofianek | 200/144 B |
| 3,870,845 | 3/1975 | Clason | 200/144 B |

*Primary Examiner*—Robert S. Macon
*Attorney, Agent, or Firm*—William Freedman; J. Wesley Haubner

[57] ABSTRACT

This vacuum-type circuit interrupter comprises a plurality of pairs of separable contacts located within an evacuated envelope and electrically connected in parallel. The movable contact of each pair is mounted on a long, slender contact rod through which current is conducted to and from the associated contact pair. The contact rods, which are also electrically in parallel, are located in side-by-side physical relationship, and each is surrounded by a tube of highly conductive metal such as copper. The tubes are fixed to the interrupter envelope and are located in adjacent side-by-side relationship, thus defining flux-controlling shields around the contact rods in which eddy currents are induced to reduce the magnetic flux penetrating into the interior of each tube from any adjacent contact rod. Means is provided for producing substantially simultaneous contact-separating motion of the contact rods.

17 Claims, 3 Drawing Figures

VACUUM-TYPE CIRCUIT INTERRUPTER WITH A PLURALITY OF SETS OF CONTACTS IN PARALLEL

BACKGROUND

This invention relates to a vacuum-type circuit interrupter and, more-particularly, to a vacuum-type interrupter that includes a plurality of spaced-apart pairs of separable contacts electrically connected in parallel for carrying current through the interrupter when closed.

In most interrupters, the force required to hold a pair of separable contacts in engagement during the passage of high current therethrough varies directly with the square of the current. It has been recognized that this force can be reduced by providing a plurality of sets of contacts electrically connected in parallel for sharing the total current through the interrupter. But this approach involves a number of problems. First of all, if the movable contact of each pair is mounted on the usual long, slender contact rod and these contact rods are arranged side-by-side, magnetic forces developed between the contact rods when high currents flow therethrough tend to force the rods together, making it difficult to properly guide and operate the rods. Another problem with parallel-connected contacts is that it is difficult during interrupting operations to consistently develop arcs at all the pairs of contacts for sharing the total arcing current through the interrupter. If arcs are developed at less than all of the contact pairs, the pair, or pairs, that do arc can be forced to carry unduly high currents through their associated arcs.

SUMMARY

A general object of our invention is to construct a vacuum-type circuit interrupter comprising parallel-connected pairs of separable contacts in such a way as to overcome the above-described problems.

Another object of our invention is to construct the interrupter in such a way that, even though long, side-by-side contact rods are used for mounting the respective movable contacts of parallel-connected pairs of contacts, high total currents through the rods result in relatively low magnetic forces therebetween.

Another object is to more consistently force the total arcing current during high current interruption to be shared by all the parallel-connected pairs of separable contacts.

One embodiment of our invention employs interleaving rod electrodes, such as shown and claimed in U.S. Pat. Nos. 3,471,754—Rich and 3,679,474—Rich, for carrying the arcing current after arcing has been initiated at the separable contacts.

Another object of our invention is to combine the contacts of the interrupter with these rod electrodes in such a way that the interrupter effects a prompt transfer of arcing current from the inter-contact gaps to the gaps between the rod electrodes.

In carrying out the invention in one form, we provide an evacuated envelope and a plurality of pairs of separable contacts located within the envelope, each pair including a movable contact. The movable contacts are respectively mounted on a plurality of elongated conductive contact rods which are located in side-by-side physical relationship and are electrically connected in parallel with each other. The contact rods extend between the exterior and interior of the evacuated envelope and are axially movable to effect separation of the contacts of the associated pair of contacts. Respectively surrounding the contact rods are a plurality of elongated tubes of highly conductive metal, each tube being radially spaced from its associated surrounded contact rod. These tubes are mounted in fixed relationship with respect to the envelope and in adjacent side-by-side relationship with respect to each other so that the tubes define flux-controlling shields around said contact rods in which eddy currents are induced to reduce the magnetic flux penetrating into the interior of each tube from any adjacent contact rod. The contacts are located outside the tubes at least when the interrupter is closed. Means is provided for producing substantially simultaneous contact-separating motion of the contact rods. A seal is provided about each of the contact rods for permitting axial movement thereof without impairing the vacuum within said envelope.

BRIEF DESCRIPTION OF DRAWINGS

For a better understanding of the invention, reference may be had to the following description taken in conjunction with the accompanying drawings, wherein.

DETAILED DESCRIPTION OF PREFERRED EMBODIMENT

Figure 1:
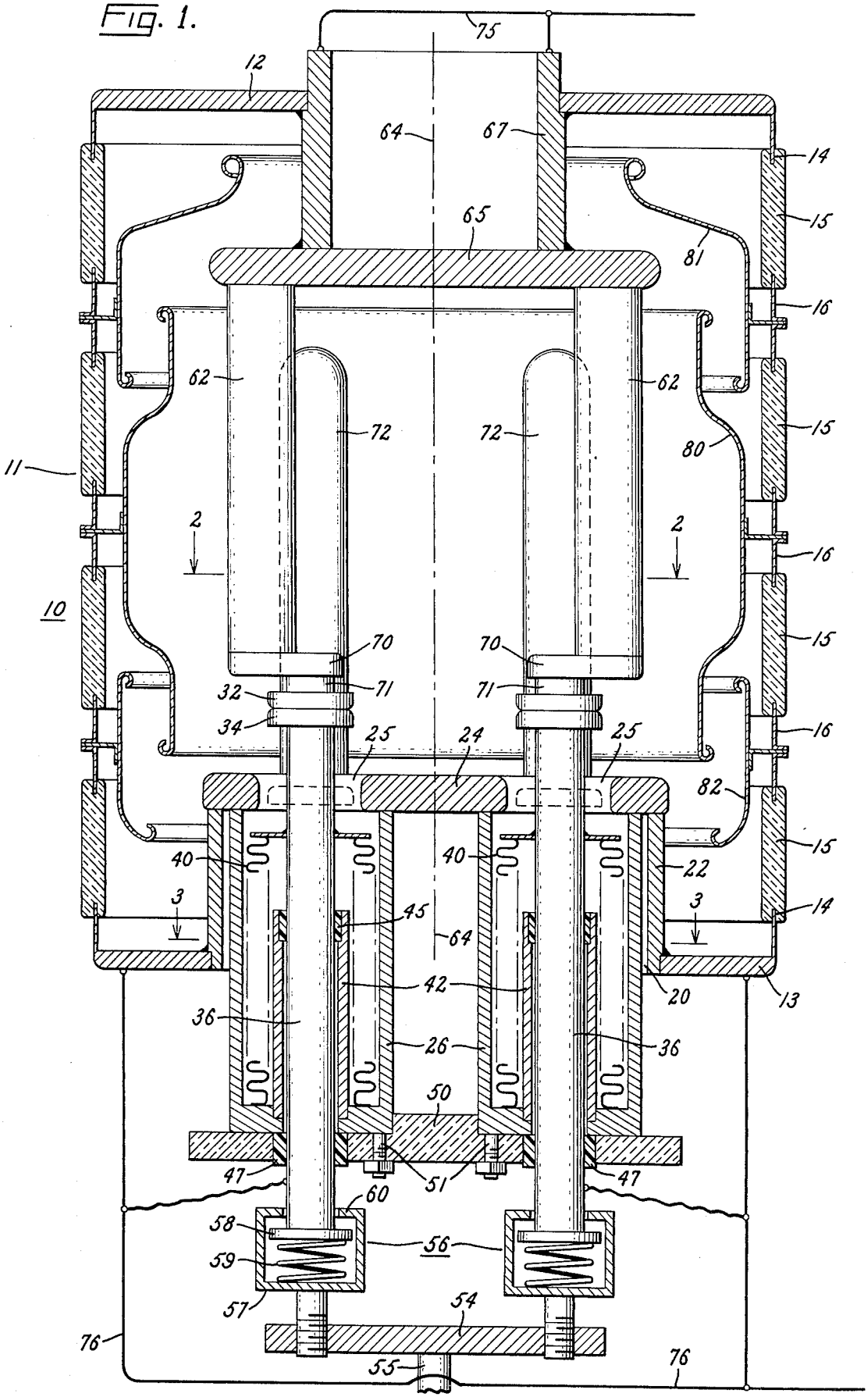
FIG. 1 is a side elevational view partly in section of a vacuum interrupter embodying one form of the present invention. Some of the interrupter parts are omitted for simplicity.

Referring now to FIG. 1, the illustrated vacuum interrupter comprises a highly evacuated envelope 10 that comprises a tubular casing 11 and a pair of spaced-apart metallic end caps 12 and 13 disposed at opposite ends of the casing and sealed thereto by conventional seals 14. The casing 11 comprises a plurality of tubular sections 15 of insulating material, such as glass, and tubular metal section 16 mechanically joining the tubular insulating sections 15 together in sealed relationship to each other.

The lower end cap 13 contains a large centrally-located circular opening 20. Aligned with this opening and extending axially inwardly of the envelope is a metal tube 22 that is suitable joined in sealed relationship to end cap 13. Extending across the upper end of tube 22 is a circular transverse plate 24 that is joined in sealed relationship to the tube 22. Transverse plate 24 contains four spaced-apart openings 25 arranged in a circular ring pattern about the center of plate 24.

Extending through the central opening 20 in the end cap 13 and respectively aligned with the openings 25 in end plate 24 are a plurality of tubes 26 of highly conductive metal such as copper. These tubes are joined at their inner ends to the plate 24 by suitable brazed joints forming a vacuum tight seal between each tube 26 and plate 24.

The interrupter further comprises a plurality of pairs of separable contacts electrically connected in parallel with each other. In the illustrated embodiment, four such contact pairs are provided, each comprising a stationary contact 32 and a movable contact 34. Each movable contact 34 is mounted on and electrically connected to an elongated conductive contact rod 36 that extends between the interior and exterior of the envelope through one of the metal tubes 26. For providing a seal between each contact rod 36 and the envelope, an elongated metal bellows 40 is provided within the tube 36 surrounding the contact rod. This bellows 40, at its upper end, is joined to the contact rod 36 by a suitable vacuum-tight joint and, at its lower end, is joined to tube 26 by a suitable vacuum-tight joint.

To assist in guiding each contact rod 36 for substantially straight-line motion along its longitudinal axis, a tubular guide 42, preferably of a non-magnetic material, is provided within each tube 26 in a position within the associated bellows 40. This guide 42 has its lower end suitably fixed to the lower end of the associated tube 26. At the upper end of the guide, there is a sleeve bearing 45, preferably of Teflon, fixed to the guide and slidably receiving the contact rod 36. Another sleeve bearing 47 supported in a stationary plate 50, soon to be described, surrounds the contact rod 36 near its lower end and provides additional guidance for substantially straight-line motion of the contact rod.

For bracing the outer, or lower, ends of the tubes 26 against movement with respect to each other, a thick plate 50 of insulating material is provided therebetween. Suitable studs 51 projecting from the lower end of each tube through openings in the plate 50 are used to clamp the plate to the lower end of each tube 26.

For coupling the movable contact rods 36 together, a common crosshead 54 is provided. This crosshead is coupled to a suitable operating mechanism (not shown) by an operating rod 55. Between the crosshead and each contact rod is a wipe mechanism 56 of a conventional design such as shown for example in FIGS. 1 and 2 of U.S. Pat. No. 3,180,960—Barkan et al., assigned to the assignee of the present invention. Each wipe mechanism 56 comprises a tubular cage 57 fixed to the crosshead and within which there is located a piston 58 and a compression spring 59 between the piston and the lower wall of the cage. The cage further comprises an inwardly extending shoulder 60 on the upper side of the piston. Opening of the interrupter is effected by driving the crosshead 54 and the cages 57 downwardly. After a small amount of such downward travel, the shoulder 60 on each cage strikes the associated piston 58 and the piston is thereafter driven downwardly through an opening stroke. During a closing operation, each cage is driven upwardly from its fully open position, transmitting driving force to its associated contact rod 36 through spring 59. After the contacts 32, 34 have engaged at the end of the closing stroke, cage 57 continues moving upwardly through a small amount of overtravel or wipe. The wipe mechanisms 56 are adjusted so that, during an opening operation, they produce substantially simultaneous downward motion of contact rods 36.

For mounting the stationary contacts 32 of the four pairs of contacts, four stationary rod electrodes 62, one for each stationary contact, are provided. The four rod electrodes 62 have longitudinal axis extending generally parallel to the central longitudinal axis 64 of the tubular envelope 11 and are arranged in a circular ring pattern about axis 64. As will be apparent from FIG. 2, the rod electrodes are radially spaced from axis 64, and their longitudinal axes are angularly spaced from each other by about 90° on a reference circle 69 having a center coinciding with axis 64. The rod electrodes 62 are fixed at their upper ends to a transversely extending circular base 65 of conductive metal. Base 65 is supported on a metal tube 67 that extends through an opening in upper end cap 12. The joints between tube 67 and base 65 and between tube 67 and end cap 13 are vacuum-tight joints, preferably made by brazing.

The contacts 32 are mounted on the lower, or distal, ends of rod electrodes 62 by conductive bars 70, each of which extends radially inward from the longitudinal axis of its associated rod electrode 62 toward reference axis 64. Contact 32 has a short extension 71 on its upper face that is suitably brazed to the lower surface of bar 70 near the radially inner end of the bar. It will be apparent from FIGS. 1 and 2 that each stationary contact 32 is located between the longitudinal axis of its associated rod electrode 32 and the reference axis 64. The significance of this contact location will soon appear more clearly.

The rod electrodes 62 are intended to serve as one set of rod electrodes in an interleaving rod electrode arrangement of the general type disclosed and claimed in the aforesaid Rich patents. The rod electrodes of the other set are shown at 72, with their lower ends fixed to the transverse conductive plate 24. Rod electrodes 72 have longitudinal axes which extend generally parallel to the central reference axis 64 in radially spaced relationship thereto and which are located substantially on the same reference circle 69 as the rod electrodes 62. Rod electrodes 72 interleave with rod electrodes 62 and are circumferentially spaced by substantially equal amounts from juxtaposed rod electrodes 62.

During a circuit-interrupting operation, arcing products from arcs developed between the contacts 31, 32 enter the spaces between the rod electrodes 62 and 72, causing these spaces or gaps to break down electrically, thus forming diffuse arcs between the juxtaposed pair of rod electrodes 62 and 72. These diffuse arcs extend generally circumferentially of the envelope and are capable of carrying relatively high currents without the formation of anode spots, as is explained in the aforesaid Rich U.S. Pat. No. 3,679,474.

The rod electrodes 72 of the lower ring are preferably of a ferrous material which exhibits a high hardness and ductility, such as one of the steels disclosed and claimed in U.S. Pat. No. 3,769,538—Harris, assigned to the assignee of the present invention. Each of the rod electrodes 62 of the other set comprises an outer cylindrical shell **62*a*, also of such a steel, but a core 62*b*** inside the shell of a highly conductive metal, preferably copper, to enable the rod electrode to carry (through its low resistance core) high continuous currents without overheating. Such a core is not needed in the lower rod electrodes since they carry current only during a portion of the brief arcing period.

The opposed terminals of the circuit interrupter are schematically shown in FIG. 1 at 75 and 76. Terminal structure 75 is electrically connected to the tube 67 in the upper end cap 12; and terminal 76 is electrically connected to the four contact rods 36 and to the lower end cap 13.

When the interrupter is closed, as shown in FIG. 1, current flows therethrough between the terminals 75 and 76 via four spaced-apart electrically-parallel paths. One of these paths extends successively through one of the contact rods 36, the associated pair of contacts 34, 32, associated contact-supporting parts 71, 70, and 62, plate 65, and tube 67. The other three paths are respectively through the remaining three contact rods 36 and the contact structures respectively associated with these contact rods.

A basic reason for providing a plurality of sets of contacts in parallel is to reduce the total force required to hold the contacts closed under high momentary currents, which in some applications may exceed 150,000 amperes peak. In a typical vacuum interrupter, the force required to hold each set of contacts closed varies directly with the square of the current therethrough. So reducing the current through each contact pair by a factor of four, as occurs when the total current is equally divided between four contact pairs, reduces the force needed at each pair to approximately one-sixteenth of its original value and reduces the total force to approximately one-fourth of its original value. But this multiple parallel-contact approach is not without its own problems, one of which, mentioned in the introduction, is referred to in the next paragraph.

When high currents flow through the interrupter via the parallel-connected contact rods 36, significant magnetic forces are developed tending to force the slender contact rods together. As will now be explained, the highly conductive tubes 26 surrounding the individual contact rods 36 serve to limit these lateral forces on the contact rods to modest levels even under extremely high currents. More specifically, these tubes act as flux-controlling shields in which high values of eddy currents are induced by flux from the adjacent contact rods. The eddy current in each tube develops a bucking magnetic field which opposes entry of flux from the adjacent contact rods into the space within the tube. By severely limiting this penetrating flux, the lateral force on the movable contact rods is severely limited.

By thus limiting the lateral magnetic forces on the contact rods 36, we can prevent the contact rods from significantly bending in response to such forces and can assure that the contact rods will operate smoothly in their guide bearings 45 without encountering binding or other interference with opening and closing motion.

While greatly reducing the lateral magnetic forces on the contact rods during high current conditions, the tubes 26 themselves are subject to high lateral magnetic forces. These forces, however, we can easily accommodate by providing heavy braces between the tubes. Transverse metal plate 24 acts as such a brace at the upper ends of the tubes and insulating plate 50 acts as such a brace at the lower ends of the tubes.

It is to be noted that the tubes 26 surround the contact rods 36 along most of their length, extending inwardly of the envelope into a region just beneath the movable contacts 34. Only a short section of each contact rod projects above its associated tube and is exposed to substantially the full flux from the adjacent contact rods.

In referring to the tubes 26 as being of a highly conductive material, we mean a material that has a conductivity at least as high as substantially that of aluminum.

Another feature that helps to limit the transverse magnetic forces on the contact rods is the fact that the contact rods are located generally symmetrically around the central axis 64. This tends to equalize the inductances of the four parallel paths through the contact rods when the interrupter is in its closed position of FIG. 1, thus tending to equalize the currents through the contact rods. If the currents are equal, the maximum transverse force on any one of the contact rods is reduced. Furthermore, the total force required to hold the contacts closed under high momentary currents is reduced if the current is equally distributed between the four contact rods. Further contributing to equality in the inductances of the four current paths through the interrupter is the fact that the four contact pairs 32, 34 and the supporting rods 62 are also symmetrically located about the central axis 64. As previously noted, circuit interruption is effected by driving the four contact rods 36 downwardly from thier position of FIG. 1 by opening force transmitted through crosshead 54 and wipe devices 56. The contact rods move downwardly substantially simultaneously, thereby separating the contacts of each pair of contacts substantially, though not precisely, simultaneously. This substantially simultaneous contact separation usually results in concurrent arcing at all four sets of contacts during high current interruptions.

There are several features contributing to the interrupter's effectiveness in forcing arcing to occur concurrently at all the contact pairs during high current interruption. One such feature is that the four contact pairs are located in relatively close proximity to each other, being located radially inwardly of the reference circle 69 on which the rod electrodes 62 and 72 are located. This close proximity results in better communication between the intercontact arcing gaps, thus increasing the accessibility of any non-arcing contact gap to arcing products from any then-arcing contact gap, thereby increasing the likelihood of arc-initiation at the non-arcing gap. The fact that the contact pairs are located outside the tubes 26, at least when closed and during most of the arcing period, also contributes to the desired free communication between the inter-contact gaps.

Another feature contributing to the interrupter's effectiveness in forcing arcing to occur concurrently at all the contact gaps during high current interruptions is that there is a radially inwardly acting force on each inter-contact arc. If arcing is occurring at all of the contacts, these radially inwardly directed forces drive the arcs and arcing products toward the central region surrounding axis 64. But if there is no arc at a given pair of contacts, arcing products are driven past the central region toward the non-arcing pair of contacts, thus promoting an electrical breakdown and arcing across the latter set of contacts. This radially inward acting force on the arcs results, in part, from the radially extending orientation of the current path immediately adjacent the contacts. This radially extending orientation results from the presence of the radially extending conductive bar 70 carrying current in a generally radial direction between rod electrode 62 and the arc. There is, in effect, a radially inward-extending bow in the current path, which bow has a magnetic effect acting in a known manner to lengthen the bow by driving the arc radially inward.

We are able to provide this radially inwardly bowing configuration in the current path and also the close proximity between the four pairs of contacts because our contact rods 36 are located relatively close together and radially inward of the reference circle 69 on which support rods 62 are located. We are able to locate the contact rods 36 in this close together relationship because of the above-described magnetic shielding produced by the highly conductive tubes 26, which shielding severely limits the transverse magnetic forces on the contact rods despite their close proximity. Thus, the presence of the conductive tubes 26 effectively contributes to more equal current distribution between the contacts during arcing.

Another feature contributing to the interrupter's effectiveness in forcing arcing to occur concurrently at all the contact gaps is the fact that the contact pairs are located generally symmetrically about the central reference axis 64. Thus, all the contact gaps are accessible to arcing products from the other gaps, even when the arc at one or more gaps moves radially inwardly under the influence of the above-described magentic bias.

The ionized arcing products resulting from the arcs developed between the contacts 32 and 34 are quickly propogated into the gaps between the rod electrodes 62 and 72. As previously explained, this lowers the dielectric strength of these inter-electrode gaps, causing them to electrically break down, thereby establishing diffuse arcs between juxtaposed rod electrodes 62 and 72. These diffuse arcs extend generally circumferentially with respect to the reference circle 69 in which the rod electrodes are located and are capable of carrying relatively high currents without the formation of anode spots, as previously mentioned.

It will be apparent from FIG. 1 that the gaps between rod electrodes 62 and 72 are in free communication with the gaps established between the contacts, and this results in rapid establishment of the previously described discharges across the inter-electrode gaps following establishment of the arcs between the contacts. In a series of tests performed with a device generally corresponding to that illustrated, only about 1 millisecond was required for current transfer to the inter-electrode gaps to start and about 5.5 milliseconds for a substantially complete transfer to occur. Although in some tests current continued to flow through the inter-contact gaps after arcs were established between the rod electrodes, this inter-contact current typically was less than 15 percent of the total current and did not prevent interruption at an early current zero. It is to be noted that the shielding tubes 26, being positioned beneath the inter-contact gaps, do not interfere with the desired free communication between the inter-contact gaps and the inter-electrode gaps.

Figure 2:
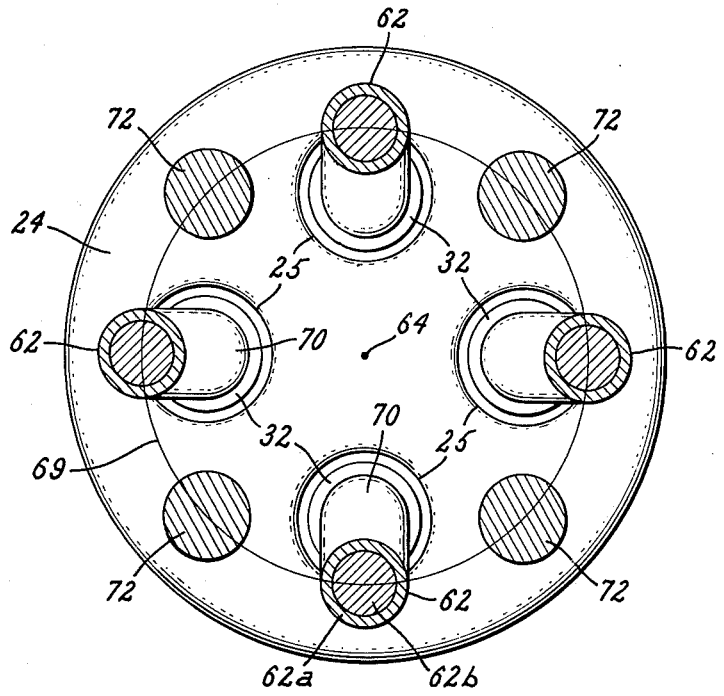
FIG. 2 is a sectional view taken along the section line 2—2 of FIG. 1.
Figure 3:
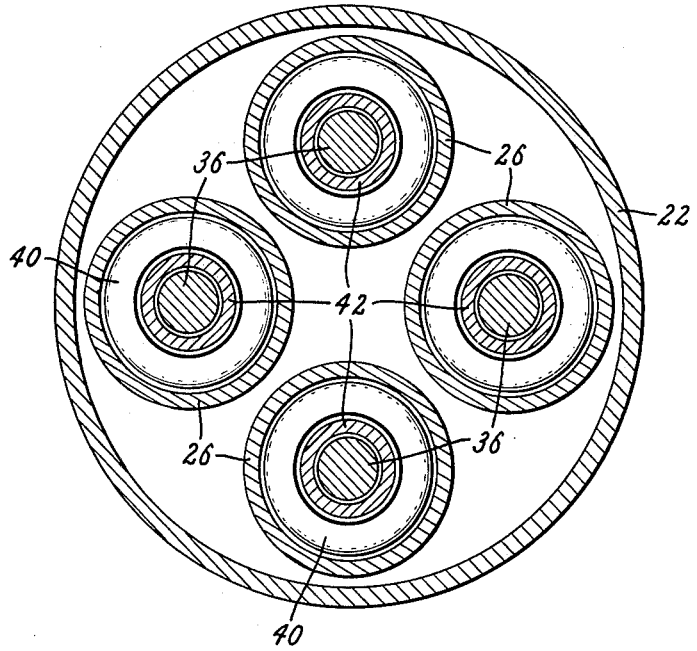
FIG. 3. is a sectional view taken along the section line 3—3 of FIG. 1. Some of the parts in this figure are omitted for simplicity.

As previously mentioned and as will be apparent from FIG. 2, the rod electrodes 62 and 72 are also arranged generally symmetrically about the central reference axis 64. This generally symmetrical relationship of the rod electrodes, together with the generally symmetrical relationship of the contacts relative to each other, enables more efficient use to be made of the space within the interrupter in the sense of allowing the maximum number of rod electrodes and contacts of a given size to be incorporated inside a casing 11 of a given diameter with given minimum clearance spaces between opposite polarity parts.

In a preferred form of our invention, the contact rods 36, the tubes 26, and members 13, 22, 24, 70, 65, 67 and 12 are of copper; the rods 72 are of steel; the rods 62 have an outer shell of steel and a core of copper; and the contacts 32, 34 are of beryllium.

For protecting the insulating casing 11 from being coated by arc-generated metallic particles, a plurality of tubular metallic shields 80, 81, and 82, each electrically isolated from each other and from the end caps 12 and 13, are provided. These shields act in a known manner to intercept and condense arc-generated metallic vapors before they can reach the insulating casing 11.

In a preferred form of the invention, the opening stroke of the movable contacts 34 is sufficiently long to carry the movable contacts into the openings 25 in the plate 24, the openings being large enough to freely receive the contacts. When the contacts 34 are in their fully-open positions, as shown in dotted lines, their upper faces are located just beneath the uper surface of plate 24, thus enabling the plate 24 to act as an effective electrostatic shield for the contacts 34 when the contacts are in or near their fully open positions. This shielding effect, which is similar to that described in U.S. Pat. No. 3,210,505—Porter, reduces the likelihood of a dielectric breakdown from any of the contacts 34 when in this region. During an opening operation, interruption is normally completed before the movable contacts 34 have reached their dotted-line positions within the openings 25.

While we have shown and described a particular embodiment of our invention, it will be obvious to those skilled in the art that various changes and modifications may be made without departing from out invention in its broader aspects; and we, therefore, intend in the appended claims to cover all such changes and modifications as fall within the true spirit and scope of our invention.

What we claim as new and desire to secure by Letters Patent of the United States is:

1. A vacuum-type circuit interrupter comprising:

a. an evacuated envelope, b. a plurality of pairs of separable contacts located within said envelope, each pair including a movable contact having a surface that engages a surface of the other contact when the interrupter is fully closed, c. a plurality of elongated conductive contact rods on which said movable contacts are respectively mounted, each movable contact being electrically connected to its associated contact rod, said contact rods being located in side-by-side physical relationship and being electrically connected in parallel with each other, said contact rods extending between the interior and exterior of said evacuated envelope and being axially movable to effect separation of the contacts of the associated pair of contacts, d. a plurality of elongated tubes of highly conductive metal respectively surrounding said contact rods, each tube being radially spaced from its associated surrounded contact rod, the engaging surfaces of said pairs of contacts being located outside said tubes when said interrupter is fully closed, e. means for mounting said tubes in fixed relationship with respect to said envelope and in adjacent side-by-side relationship with respect to each other so that said tubes define flux-controlling shields around said contact rods in which eddy currents are developed to substantially reduce the magnetic flux penetrating into the interior of each tube from any adjacent contact rod, f. means for producing substantially simultaneous contact-separating motion of said contact rods, g. and means providing a seal about each of said contact rods that permits axial movement thereof without impairing the vacuum within said envelope.

2. The vacuum-type circuit interrupter of claim 1 in which the sealing means of (g) for each contact rod comprises a flexible tubular bellows located within the tube associated therewith, said bellows having one end connected to said contact rod and its other end connected to said tube.

3. The vacuum-type circuit interrupter of claim 1 in combination with:

a. a metal plate extending transversely of the longitudinal axes of said tubes and containing openings through which said contact rods extend, b. a first plurality of rod electrodes mounted on said plate and extending generally parallel to the axes of said tubes, said rod electrodes being located at circumferentially spaced points generally on a predetermined reference circle, c. means for electrically connecting said plate and said first plurality of rod electrodes to said movable contact rods, d. a second plurality of rod electrodes interleaving with and extending generally parallel to said first plurality of rod electrodes and being disposed generally on said reference circle in circumferentially spaced relationship to the adjacent electrodes of said first plurality of rod electrodes, e. arcing gaps between juxtaposed interleaving electrodes of said first and second plurality, which gaps are in free communication with the gaps developed between the contacts upon contact separation, f. and a pair of terminals at opposite ends of said envelope, one terminal being electrically connected to said first plurality of rod electrodes when said interrupter is open and the other terminal being electrically connected to said second plurality of rod electrodes when said interrupter is open.

4. The vacuum interrupter of claim 1 in combination with:

a. first and second pluralities of rod electrodes interleaving with each other and forming arcing gaps between juxtaposed electrodes, b. first and second terminals at opposite ends of said envelope, said first terminal being electrically connected to said first plurality of electrodes and said second terminal being electrically connected to said second plurality of electrodes, c. means for electrically connecting said first terminal and said movable contacts when said interrupter is open, d. and means for respectively mounting the other contacts of said pairs of contacts on the rod electrodes of said second plurality and for electrically connecting each of said other contacts to its associated rod electrode of said second plurality.

5. The vacuum interrupter of claim 4 in which said other contacts are located near the ends of the rod electrodes of said second plurality.

6. The vacuum interrupter of claim 4 in which said pairs of contacts are located in positions disposed radially inwardly of said reference circle.

7. A vacuum-type circuit interrupter comprising:

a. an evacuated envelope within which is located a predetermined reference axis, b. a first plurality of rod electrodes, each extending generally parallel to said reference axis and radially spaced from said reference axis, said rod electrodes being arranged in a generally circular ring around said reference axis and being circumferentially spaced from each other, c. a second plurality of rod electrodes within said envelope, each extending generally parallel to said reference axis and radially spaced from said reference axis, said second plurality of rod electrodes being arranged in a generally circular ring around said reference axis, interleaving with said first plurality of electrodes and being circumferentially spaced therefrom, thereby defining arcing gaps between the juxtaposed interleaving electrodes of said first and second plurality, d. a pair of terminals at opposite ends of said envelope, the first of which is electrically connected to said first plurality of rod electrodes and the second of which is electrically connected to said second plurality of rod electrodes, e. a plurality of pairs of separable contacts electrically connected in parallel with each other, each pair comprising a first contact and a second contact, f. mounting means for respectively mounting said first contacts on the rod electrodes of said first plurality of rod electrodes in positions between said reference axis and the longitudinal axis of the rod electrode on which the particular contact is mounted, said mounting means defining a conductive path between each of said first plurality of rod electrodes and the contact mounted thereon, which path has a portion adjacent its associated contact extending generally radially with respect to said reference axis, g. elongated conductive contact rods that are axially movable and are electrically connected in parallel with each other, h. means for respectively mounting said second contacts on said movable contact rods and for electrically connecting each of said second contacts to the contact rod on which it is mounted, i. and means for actuating said contact rods substantially simultaneously to effect substantially simultaneous contact separation at said pairs of contacts.

8. The vacuum interrupter of claim 7 in combination with a plurality of elongated tubes of highly conductive metal respectively surrounding said contact rods, each tube being radially spaced from its associated surrounded contact rod, and means for mounting said tubes in fixed relationship with respect to said envelope and in adjacent side-by-side relationship with each other so that said tubes define flux-controlling shields around said contact rods in which eddy currents are developed to substantially reduce the magnetic flux penetrating into the interior of each tube from any adjacent contact rod.

9. The vacuum interrupter of claim 7 in combination with a conductive base extending transversely of the rod electrodes of said first plurality for supporting and electrically interconnecting the rod electrodes of said first plurality at one end of each of said latter rod electrodes, the opposite ends of said latter rod electrodes being distal ends in the region of which said first contacts are located.

10. The vacuum interrupter of claim 7 in which:

a. arcs are normally developed concurrently at said contact pairs upon substantially simultaneous actuation of said contact rods, immediately following which there are established across the arcing gaps between said juxtaposed interleaving rod electrodes discharges into which most of the arcing current is transferred, and b. said inter-electrode arcing gaps freely communicate with the gaps established between said contacts upon contact-separation, whereby arcing products from the inter-contact gaps can freely enter the inter-electrode gaps and induce electrical breakdown of said inter-electrode gaps.

11. The vacuum-type circuit interrupter of claim 1 in which:

a. said means of (e), claim 1, for mounting said tubes comprises a metal plate electrically connected to said movable contact rods, extending transversely of the longitudinal axis of said tubes and containing openings through which said rods extend, and b. said plate is positioned closely adjacent the locations of said movable contacts when said movable contacts enter their fully open positions.

12. The interrupter of claim 11 in which said movable contacts enter said openings in said plate when entering their fully open positions.

13. The interrupter of claim 11 in which:

a. said means of (a), claim 11, further comprises a tubular metal member surrounding all of said tubes and having an inner end joined to said plate, and b. said envelope comprises a metal end cap to which the outer end of said tubular member is joined, said end cap containing an opening through which said tubes extend.

14. The vacuum interrupter of claim 13 in combination with:

a. a first plurality of rod electrodes mounted on said plate and extending generally parallel to the axes of said tubes, said rod electrodes being located at circumferentially spaced points generally on a predetermined reference circle, b. means for electrically connecting said plate and said first plurality of rod electrodes to said movable contact rods, c. a second plurality of rod electrodes interleaving with and extending generally parallel to said first plurality of rod electrodes and being disposed generally on said reference circle in circumferentially spaced relationship to the adjacent electrodes of said first plurality of rod electrodes, d. arcing gaps between juxtaposed interleaving electrodes of said first and second plurality, which gaps are in free communication with the gaps developed between the contacts upon contact separation, e. and a pair of terminals at opposite ends of said envelope, one terminal being electrically connected to said first plurality of rod electrodes when said interrupter is open and the other terminal being electrically connected to said second plurality of rod electrodes when said interrupter is open.

15. The vacuum interrupter of claim 1 in which said highly conductive metal of said tubes is a metal having a conductivity at least as high as substantially that of aluminum.

16. The vacuum interrupter of claim 8 in which said highly conductive metal of said tubes is a metal having a conductivity at least as high as substantially that of aluminum.

17. The vacuum interrupter of claim 1 in combination with means for electrically connecting said tubes and said contact rods.

* * * * *